United States Patent [19]

Byers

[11] Patent Number: 5,074,244

[45] Date of Patent: Dec. 24, 1991

[54] SPRAY MARKING NOZZLE

[75] Inventor: Ronnie K. Byers, Pullman, Wash.

[73] Assignee: Metriguard Inc., Pullman, Wash.

[21] Appl. No.: 468,576

[22] Filed: Jan. 23, 1990

[51] Int. Cl.[5] ..... B05C 11/00

[52] U.S. Cl. ..... 118/669; 118/672; 118/712; 118/313; 118/315; 239/418; 239/424.5

[58] Field of Search ..... 118/668, 669, 672, 712, 118/313, 315; 239/407, 413, 418, 423, 424.5, 549

[56] References Cited

U.S. PATENT DOCUMENTS

| | | | |
|---|---|---|---|
| 909,190 | 1/1909 | Keller | 239/423 |
| 1,784,513 | 12/1930 | Coberly | 239/418 |
| 2,362,213 | 11/1944 | Miller et al. | 239/418 |
| 2,531,174 | 11/1950 | Tomlin | 239/418 |
| 2,655,988 | 10/1953 | Marra | 239/418 |
| 3,174,691 | 4/1963 | Haviland | 239/418 |
| 3,194,063 | 7/1965 | Mckean | 73/100 |
| 3,196,672 | 7/1965 | Keller | 73/100 |
| 4,880,164 | 11/1989 | Noordermeer | 239/423 |

FOREIGN PATENT DOCUMENTS

| | | | |
|---|---|---|---|
| 53-40935 | 10/1978 | Japan | 239/418 |

OTHER PUBLICATIONS

Metriguard Inc & Irv. Moore Brochure, "CLT-Continous Lumber Tester" Metriguard Inc., CLT Grade Spray Controller Operation Manual, 1987.

Spraying Systems Co. Inc. Cat. #27, pp. 48, 51, 53.

*Primary Examiner*—Richard V. Fisher

*Assistant Examiner*—Todd J. Burns

[57] ABSTRACT

A spray marking nozzle includes features allowing it to perform well for fast marking of materials. The nozzle utilizes gas as a transport medium to carry liquid to the target material as a spray. Features of the nozzle allow it to be constructed economically in a compact size and to be controlled at high speed with little or no carry over spray and over a wide range of liquid and gas pressures.

18 Claims, 7 Drawing Sheets

SPRAY MARKING NOZZLE

TECHNICAL FIELD

The invention pertains to a spray marking nozzle for the high-speed ink marking individual locations on materials, specifically lumber, while it is moving past the nozzle at high speed.

BACKGROUND OF THE INVENTION

The lumber industry over the past century has been tending to sort lumber into various groups referred to as grades. The graded lumber has more value than ungraded lumber. During the last few years, an electromechanical grading system has been developed for sorting lumber according to its modulus of elasticity (bending stiffness). This system, known as machine stress rating (MSR), was implemented in North America in the early 1960's. Background information on MSR sorting methods and equipment can be found in U.S. Pat. No. 3,194,063 (McKean) and 3,196,672 (Keller). A machine known as the CLT-Continuous Lumber Tester, hereinafter referred to as CLT, is based on the Keller patent and is responsible for most of the MSR lumber production in high speed North American lumber mills. Information about the CLT as it is presently manufactured and sold can be found in a brochure entitled CLT-Continuous Lumber Tester by Irvington Moore and Metriguard Inc., the joint producers of this equipment.

In the production-line the CLT measures the modulus of elasticity, hereinafter referred to as E, along the length of each board. The CLT places the board into an E category and automatically marks it based on two numbers determined by the CLT. These numbers, average E and low point E, are respectively the average and the lowest of the E measurements along the length of the board, and the E category of the board is identified from a comparison of average E and low point E with threshold values. When compared with visually graded lumber, MSR lumber has greater value in engineered structures where knowledge of material properties is important.

In Europe, Australia, and New Zealand, the practice for MSR lumber production requires that lumber be marked according to E category on a local basis along the length of each board. This requires the capability of a rapidly changing mark along the length of each board as well as from board to board. Additionally, in North America and elsewhere, knowledge of the E variation along the length of individual boards of lumber is becoming more important. Low E sections can be removed and high E sections can be joined together by existing finger end-joining technology, thereby producing joined boards having high E throughout. Studies of laminated beam properties, which utilize maps of local E values, will benefit from the efficient and precise E category marking on the constituent laminae.

Most of the MSR lumber produced in North America has an ink spray mark applied along a short length at a single location on each board, the mark being applicable to the entire board. The E category is identified by the spray color, but the shape and location of the mark are not critical other than the requirement of it being visible to either a machine or a human as input for use in determining the board grade and for subsequent sorting operations.

Recent introduction of the CLT for MSR lumber production in Australia and New Zealand has required a high speed ink marking system for categorization of E on a local basis rather than on a board by board basis as in North America. Spray marking technology already in use in Australia and New Zealand prior to the CLT's introduction was not satisfactory for use with the CLT because of the CLT's much higher operating speeds than the equipment it replaces.

Lumber speeds in the CLT can be as much as 24 feet/second (7.3 meters/second). At 24 feet/second, the lumber moves past a fixed spray marking nozzle at the rate of 1 inch (2.54 cm) in 0.0035 seconds. Consequently, to achieve a marking resolution in the neighborhood of 1 inch, the marking equipment must be capable of turning on and off in about 0.003 to 0.005 seconds.

For use with the CLT in Australia and New Zealand, Metriguard Inc. developed a high speed ink marking system having the required response time. The system included a grade spray controller for use in identifying E category on a local scale, an ink tank system, high speed solenoid valves for controlling ink flow (ink valves), and a nozzle block arrangement configured to spray 5 different ink colors. Ink valves used were the Model AM-055-1-12 available from Angar Scientific Company, Inc. of Cedar Knolls NJ. The nozzle block is manufactured from a block of stainless steel and has 5 ink inlet ports, 1 inlet air port, 5 exit orifices, and the required internal ink and air passageways. These internal ink and air passageways are drilled deeply using a small diameter drill bit. It is difficult to perform this drilling operation and in the event of a drill bit failure the block is rendered useless and must be scrapped. The nozzle block is configured for direct mounting of 5 ink valves such that the valves control ink flow in the corresponding nozzle block ink passageways. A continuous flow of air is routed through the exit orifices as a transport medium to carry ink to the lumber. Ink flow exiting an ink valve travels via an internal passageway in the nozzle block and joins an internal air passageway leading to a corresponding exit orifice. The ink joins with the air flow within the nozzle block, and the mixture is carried out of the exit orifice by the continuously flowing air. Additional information about the Metriguard high speed ink marking system is contained in the Metriguard Inc. CLT Grade Spray Controller Operation Manual.

The Metriguard high speed ink marking system has been successful at CLT speeds; however, it requires careful control of both air pressure and ink pressure to achieve the precision of marking desired at these speeds. The nozzles can produce a fog instead of a spray. The fogging is believed caused by the air meeting the ink internally in the nozzle so that the turbulent action of the mixture in the remaining internal passageway prior to the exit orifice atomizes the ink into a finer spray than is desireable for a crisp ink mark. Another problem is that the ink marks can be elongated after the ink valves are shut off. It is believed that the mark elongation is caused by residual ink adhering to the internal walls of the nozzle block in the region downstream of the point where the air and the ink come together and are mixed. When an ink valve is shut off, the continuous air flow carries out the residual ink, leading to elongation of the ink mark past the point corresponding to the ink valve being shut off. Still another problem is that for some combinations of air and ink pressures, ink can flow backwards into the air line, or air can flow into the ink line. By trial and error, ink and air pressures can be set to minimize these problems, but a less critical solution was desired.

High resolution ink marking involves low transit time of ink in flight to the moving lumber target. Consequently, high ink velocities from the exit orifice are desired, and this is achieved at significantly lower pressures when using a gas such as air for a transport medium compared with the alternative of using just ink alone. The conclusion is that a system using a gas to carry ink to the target is desirable.

Introducing ink to an air stream external from the nozzle rather than internal to the nozzle is a method used in paint sprayers, e.g. the Model 75 paint gun available from the Sharpe Manufacturing Co. of Los Angeles CA. In an attempt to improve the Metriguard high speed ink marking system, the Metriguard system was tested using external mix nozzles available from Spraying Systems Co. of Wheaton IL. These nozzles consisted of two parts, a fluid cap and an air cap. Experiments with fluid cap Model 2050 were run with both air caps Model 67228-45 and Model 64. For these combinations, ink exists from a circular liquid orifice and air exits from an annular gas orifice, the annulus being concentric with the liquid orifice. The nozzle was fit to the Model AM-055-1-12 Angar valve using an intermediate manifold. No combination of ink and air pressures was found that allowed control of the Angar valve and nozzle to start and stop the ink mark in the time required. Further, the structure of the Spray Systems nozzles in common with others of this general type requires them to be disassembled for cleaning, causes them to be more costly than necessary, and makes it physically difficult to mount them closely enough to one another for spray marking a common area. The lumber marking application requires that for best resolution, any one of a set of nozzles can spray the same area at a given time. Any spacing of the nozzles in the direction of motion leads to degradation of marking accuracy along the direction of motion or complication in the control circuitry. Spacing in a direction transverse to the direction of motion leads to problems of aiming the nozzles at a common target area.

The available nozzles of the external mix gas/liquid type all utilized a gas orifice that was symmetrical about the liquid orifice. While attempting to construct a simplified and more compact nozzle of this type, with a symmetrical array of tiny gas holes about a liquid hole in a block of metal to approximate an annular gas orifice, difficulty was encountered in drilling the multiple array of gas holes. Specifically, the tiny drill bit did not survive to the last hole. In frustration, an experiment was performed wherein a nozzle with only one gas orifice adjacent to a liquid orifice was combined with an Angar Model AM-055-1-12 valve and Metriguard Grade Spray Controller. Liquid passageway connections were made from the liquid orifice through the nozzle and valve combination to a pressurized liquid ink source, and a gas passageway connection was made from the gas orifice through the nozzle to a pressurized air source. The surprising result was a nozzle that performs exceptionally well for the ink spray marking application.

OBJECTIVES AND ADVANTAGES

The nozzle of the present invention has the following objectives and advantages.

(a) The nozzle operates with the Metriguard high speed ink marking system.

(b) The nozzle makes crisp highly resolvable ink marks on lumber moving at high speeds without fogging or elongation of the marks.

(c) The spray pattern from this nozzle remains reasonably well collimated for marking at relatively large distances.

(d) The high speed capabilities of the nozzle are excellent over a wide range of air and ink pressures making it insensitive to these settings. In fact, the ink line feeding the nozzle can extend from unpressurized ink tanks using a gravity head, leading to greatly simplified ink tank design. Ink pressure either from a gravity head or from other means can be used to control the ink flow rate through the nozzle. Air pressure can be used to control the velocity of the ink/air mixture and hence the delay time after the control signal is applied until ink reaches the target.

(e) The nozzle is simple, and it can be of one piece design that is easily manufactured at low cost. This is particularly true because exit liquid and gas passageways extending out to the liquid and gas orifices in the exit surface can be parallel drilled holes and can intersect the exit surface at right angles.

(f) The nozzle can be very compact.

(g) Both air and ink orifices of the nozzle can be cleaned simply by inserting a standard drill bit.

(h) The nozzle uses external mixing of liquid with gas which effectively prevents backfeeding of ink into the gas line, or gas into the ink line.

The effectiveness, flexibility of operation and control, and simplicity of design and manufacture using the teachings of the present disclosure will become further apparent from the descriptions of preferred embodiments.

BRIEF DESCRIPTION OF THE DRAWINGS

The preferred embodiment of the invention is illustrated in the accompanying drawings, in which.

DETAILED DESCRIPTION OF PREFERRED EMBODIMENTS

The following disclosure of the invention is submitted in compliance with the constitutional purpose of the Patent Laws "to promote the progress of science and useful arts" (Article 1, Section 8).

SINGLE LIQUID NOZZLE

Figure 1:
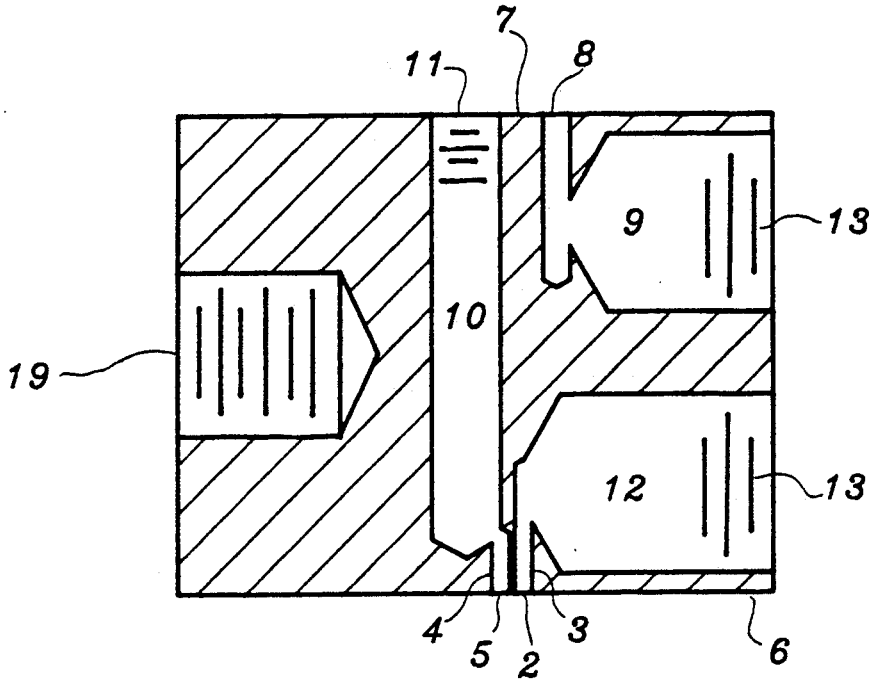
FIG. 1 is a centerline section view of a single liquid nozzle.

First, the preferred embodiment of the nozzle for a single liquid is described. Referring to FIG. 1, a single block of stainless steel is drilled and ported for gas, liquid and valve attachments. Gas orifice 2, exit gas passageway 3, liquid orifice 5, and exit liquid passageway 4 are formed by drilling holes into exit surface 6 to depths of 0.15 inch (3.8 mm) and 0.25 inch (6.4 mm) respectively using a 0.040 inch (1.02 mm) drill bit. These holes are perpendicular to the exit surface, are parallel to one another, and are separated by a distance of 0.052 inch (1.32 mm). Other sizes, separations and depths of holes for the gas and liquid orifices and exit passageways can be used. The size of the gas orifice and exit gas passageway determines the characteristics of the spray pattern as well as affecting the amount of gas consumed. The size of the liquid orifice and exit liquid passageway affect the amount of liquid sprayed at any given liquid pressure, but it is important that the liquid orifice size be small enough so that liquid surface tension prevents liquid droplets escaping from the liquid orifice when the liquid is valved off. The exact size of the liquid orifice and exit liquid passageway was chosen for availability of the drill bit, recognizing that the same size drill bit can be used during nozzle maintenance for quickly cleaning the orifice and exit passageway. The physical separation of the adjacent gas and liquid orifices should be small enough to ensure that the liquid flow from the liquid orifice for the range of liquid pressures used is reliably drawn into the gas flow by the low pressure area produced by the gas flow. Depths of the exit passageways are shallow for ease of manufacturing, and they are drilled first to reduce frequency of drill bit breakage and to reduce costs in event of drill bit breakage.

A valve mounting surface 7 is prepared for mounting a liquid valve, the Angar Scientific Company Model AM-055-1-12, to the nozzle. The surface finish is milled smooth enough for o-ring sealing of the valve body to the surface. A first part of an intermediate liquid passageway 8 is drilled from the valve mounting surface to the inlet liquid port 9 so that liquid from the liquid source can reach the valve. A second part of the intermediate liquid passageway 10 is drilled from the valve mounting surface to the exit liquid passageway. The end 11 of this passageway nearest the valve mounting surface is threaded for mechanical attachment of the valve.

In the case of this preferred embodiment, an intermediate gas passageway is not required because the inlet gas port 12 connects directly with the exit gas passageway. In other embodiments, an intermediate gas passageway may be necessary. Inlet gas port 12 and inlet liquid port 9 are threaded 13 for connectors.

Figure 2:
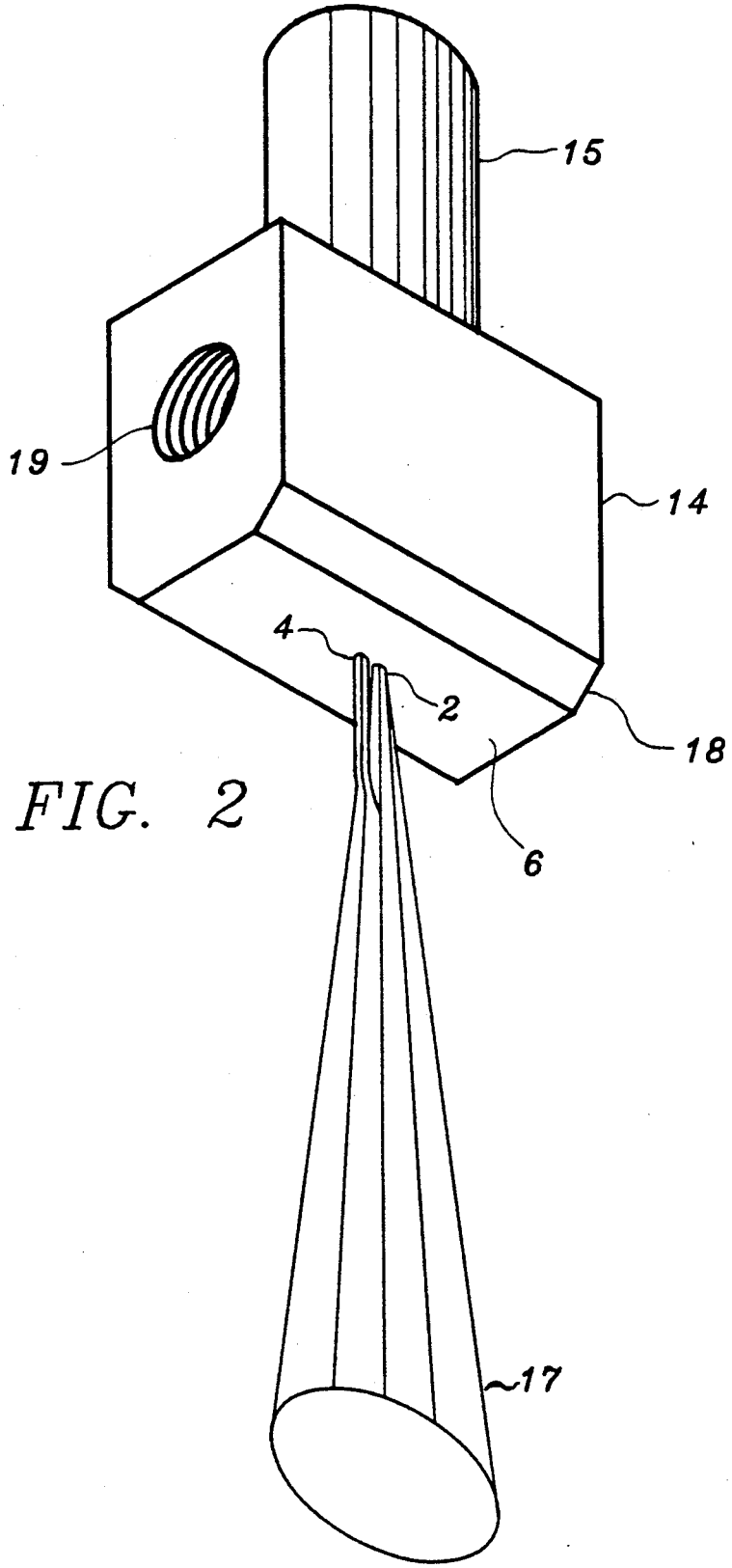
FIG. 2 illustrates a single liquid nozzle and valve combination along with a typical spray pattern that might result.

Referring now to FIG. 2, the corners of the nozzle have been beveled 18 so that a plurality of nozzles can be arranged more conveniently to spray a common target area, and a mounting hole 19 is drilled and tapped in one end for ease in mounting.

It is not essential that the valve mounting be on the nozzle or even that there be a valve. The most general arrangement would connect the gas and liquid orifices to respective inlet gas and liquid ports. Control of the liquid flow from the liquid orifice is by control of pressure at the inlet liquid port and pressure just outside the liquid orifice. Pressure outside the liquid orifice is controlled according to Bernoulli's law by the flow of gas from the gas orifice and hence by the gas pressure at the inlet gas port. Depending on the relative values of the inlet liquid and gas port pressures and orifice sizes, the liquid flow can be made to depend primarily on inlet liquid port pressure. Use of a valve together with control of liquid pressure upstream of the valve is one means of controlling pressure at the inlet liquid port. Mounting the valve on the nozzle moves some of this control onto the nozzle area, and that can provide some practical and technical advantage as will become apparent.

To be able to shut the nozzle off in a short time, without residual carryover requires a fast valve, a "stiff" cavity between the valve and liquid orifice, and a liquid orifice small enough that liquid surface tension prevents liquid from exiting the orifice when the valve is off. A stiff cavity is one that has negligible change in volume for small changes in pressure; hence, with the valve off, the liquid in the cavity will not exit the liquid orifice as a result of gas flow from the gas orifice. These constraints prevent liquid from dribbling out of the liquid orifice and being carried toward the target by the gas transporting medium when the liquid valve is off. By locating the valve on the nozzle, as in this preferred embodiment, the volume of the cavity can be kept small and the cavity walls rigid.

FIG. 2 illustrates the nozzle 14 with the Angar valve 15 attached and also a typical spray pattern 17. It is understood that the invention is not restricted to this particular valve, it being selected for use with the present invention because of its speed capabilities and ease of mounting. As previously discussed, it is not necessary that a valve be mounted directly on the nozzle as shown in FIG. 2 because a separate valve mounting with suitable plumbing can be used. It is important that the liquid cavity comprising the intermediate and exit liquid passageways downstream of the valve be small with rigid walls to prevent escape through the liquid orifice of the liquid contained in this cavity when the valve is closed.

For best control of liquid density in the spray, it is also desirable that when the valve opens, pressure at the valve inlet be maintained as desired. A method for maintaining the pressure and hence liquid density at a constant value is to use a small accumulator in the liquid source as near to the valve inlet as possible. Other means for pressure control may be desirable, especially if the liquid density in the spray is to be varied. The pressure control should be as close as possible to the valve to minimize effects of liquid inertia downstream from the region of controlled pressure. In the preferred embodiment, size of the liquid cavity and rigidity of the liquid cavity walls downstream of the valve is ensured by mounting the valve directly to the nozzle. The effect of a small accumulator close to the valve and hence smoothing of pressure pulses was achieved by using flexible tubing to supply liquid to the nozzle's inlet liquid port.

Although a marking system for the CLT machine would naturally use an array of single liquid nozzles or a multiple liquid nozzle as described in the following, just one single liquid nozzle can also be used. One nozzle and valve combination can be aimed at a track on the lumber and controlled so as to spray a bar code pattern onto the lumber in correspondence with the measured E value. The E value is first coded into a bar code of sequential binary values using known methods. Then this sequence of binary values is used to control on and off the valve. The result is a sequence of spray marks along the board that is representative of the measured E. Each sequence represents one E value and the number of sequences along the board, and hence the geometric resolution of E values along the board obtainable by reading the bar codes, is determined by the resolution of the individual spray marks at the operating speed. It is clear that best resolution is obtainable with the fastest spray marking system.

Similarly, any other binary code representing the E value or other value to be identified on a piece of material can be used to control the valve on this single nozzle spray marking system.

ARRAY OF SINGLE LIQUID NOZZLES WITH VALVES

Figure 3:
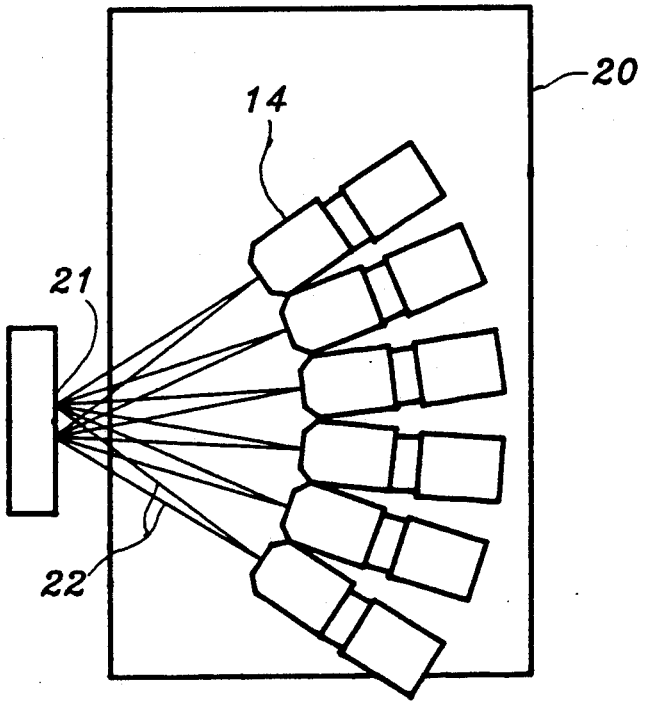
FIG. 3 is a view of an array of single liquid nozzle and valve combinations of FIG. 2 arranged in an arc to spray a common area.

FIG. 3 illustrates a nozzle and valve array mounted on a common plate 20 and arranged in an arc so the nozzles 14 can spray a common target area 21 at the arc radius distance 22.

Figure 4:
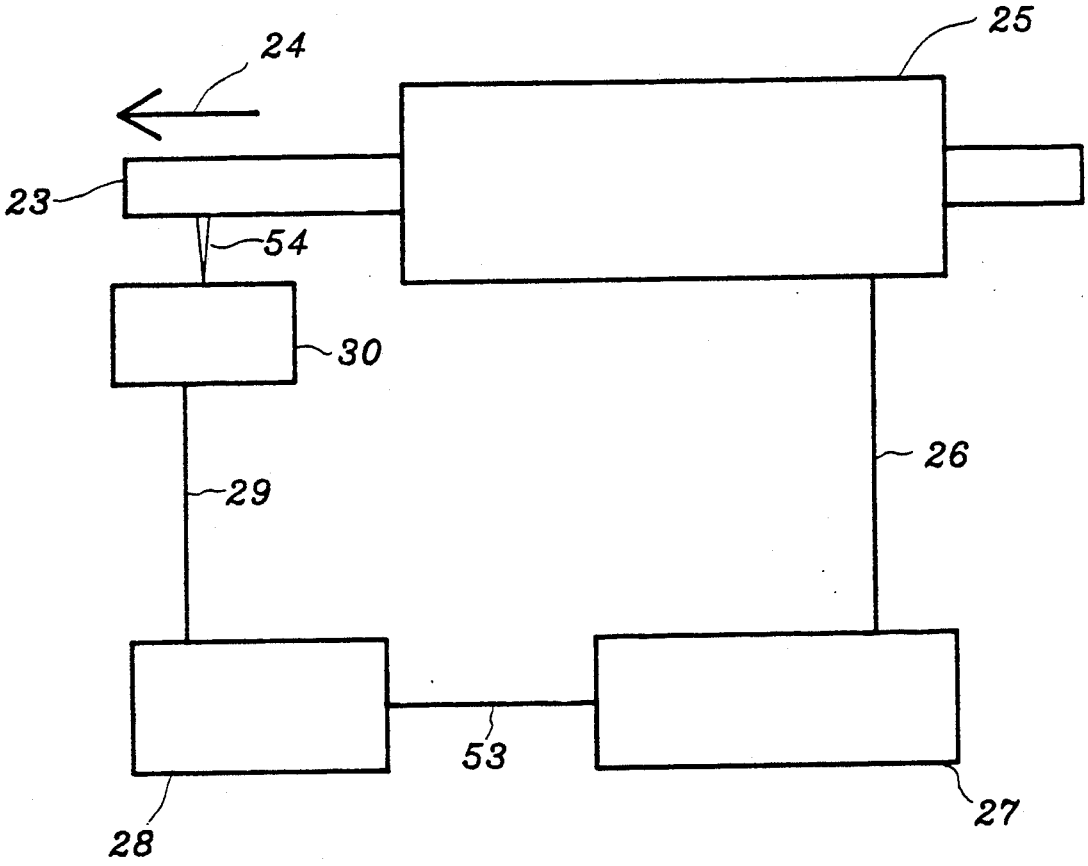
FIG. 4 is a schematic view illustrating the major components of a high speed marking system as part of the machine stress rating lumber grading process.
Figure 5:
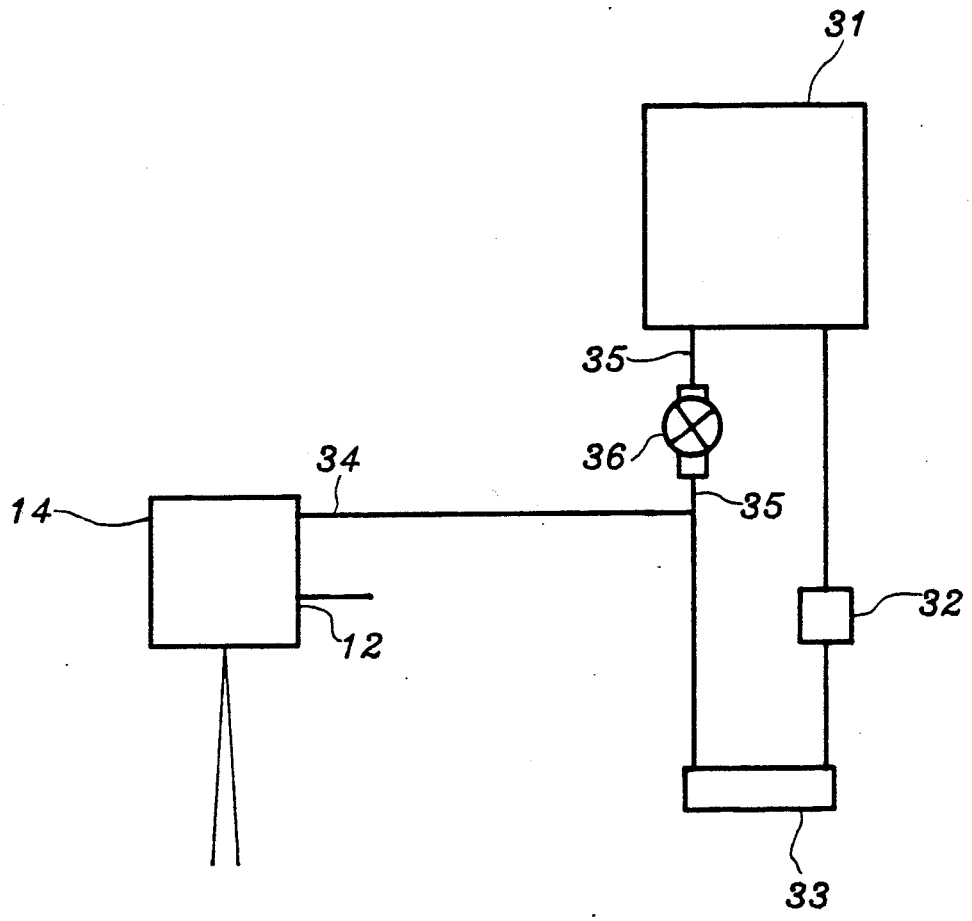
FIG. 5 is a schematic view of the liquid handling part of the CLT Continuous Lumber Tester ink marking system in FIG. 4.

FIG. 4 illustrates schematically parts of the high speed marking system used in the MSR grading process for lumber. As a board 23 moves in direction 24 through the CLT machine 25, signals 26 are sent to the CLT electronic unit 27, and a measurement of the varying E along the board is obtained. For each location along the board, the measured E value 53 is sent to the grade spray controller 28 where the E value is compared with thresholds to classify that location on the board into one of five or six E categories. The E category value directs the grade spray controller to supply actuating signals 29 to the valves of a nozzle and valve array 30. The nozzles mark the E category at each point along the board by applying a spray identification mark 54 unique to that E category. This is accomplished in the CLT by supplying the different nozzles in the array with different colors of liquid ink and actuating only one valve at a time. It is clear that more than one valve could be actuated at the same time, thereby creating many more spray combinations than the single sprays wherein just one valve is actuated at a time. FIG. 5 illustrates the liquid handling part of the CLT ink marking system for one of the nozzles. It includes a liquid ink tank 31, filter 32, liquid pump 33, and flexible tubing 34 to the nozzle. A liquid return line 35 from the liquid pump to the ink tank with adjustable restriction 36 helps agitate and mix the ink solution. The liquid ink tank is Model 75023 from United States Plastics Corp. of Lima OH, the filter is Model G-1 from Fram Corp. of Providence R.I., the liquid pump is Model 35-17Q from Winpro Inc. of Farmingdale N.Y., and the flexible tubing is No. BL606 latex tubing from Kent Latex Products of Kent OH. The Winpro liquid pump is self regulating to a maximum pressure. Pressure pulses from the pump are smoothed by the flexible tubing leading to the nozzle. Compressed air at pressures in the approximate range of 10 to 30 psi is applied to the inlet gas port 12 of the nozzle 14.

Although not presently done in the MSR grading process for dimension lumber, it is clear that other measured properties of the wood boards could be identified by spray marks on the boards with the same spray marking system. Further, it is clear that spray marks identifying a data value or information completely independent of the lumber being processed, e.g. time of day or customer identification, could be applied to the boards. It is also to be understood that the machine and spray marking system could be applied to materials other than lumber. It is further to be understood that the machinery used for processing the material can process it by methods other than those mentioned. For example, the processing could involve only the relative motion of the material relative to the spray marking system and the application of the spray marks.

The system of FIGS. 4 and 5 has been successfully tested in the laboratory. Also the system was tested using only gravity feed ink pressure. Ink pressure variation was observed to cause variation in density of the ink mark with little effect on its resolution, proving that ink pressure is an effective means of controlling liquid spray density and hence ink mark density. It is necessary to maintain enough ink pressure at the higher CLT machine speeds to have sufficient ink mark density for good readability. Excellent resolution of the ink mark along the length of a board without either excessive fogging or ink mark elongation is maintained over a wide range of ink pressure and air pressure, features not heretofore attained.

An array of single liquid nozzles can be used to define a binary coded spray location marking system. This system codes the measured property value into an n-bit binary code. An array of n single liquid nozzles is used, each nozzle pointing at a track on the material, the track in correspondence with one of the n bits. The liquids can be the same or different, and they are individually valved on or off depending on whether the corresponding bit is on or off. Thus the pattern of spray marks for the n tracks can be read at each location on the material in the direction of motion as a binary code of the material property value at that location.

Similarly, an array of single liquid nozzles can be used as a dot matrix spray marking system. A dot matrix code is generated from the property value and used to control an array of single liquid nozzles, each nozzle pointing at a track on the material. In this case each track corresponds to a row of dots in the dot matrix. The number of tracks, and hence number of nozzles in the array, is equivalent to the number of pins that would be used in a dot matrix printer if it were used to generate the same character. Control of the nozzles causes a dot matrix pattern to be sprayed on the material that is in correspondence with the property value and that is easily readable. For example, the property value could be quantized into a 3 digit decimal number that is spray marked as a dot matrix pattern onto the material and readable directly as this 3 digit number. The frequency of dot matrix patterns and hence geometric resolution of the property value identification along the material is determined by the crispness and speed of the spray marking system.

It is clear that this array of nozzles could be of one piece construction by recognizing that the exit surfaces of the individual nozzles can be considered to comprise a common exit surface. It is also clear that all but one inlet gas port could be eliminated so that the gas passageways lead from the single remaining inlet gas port to the gas orifices.

MULTIPLE LIQUID NOZZLE

Figure 6:
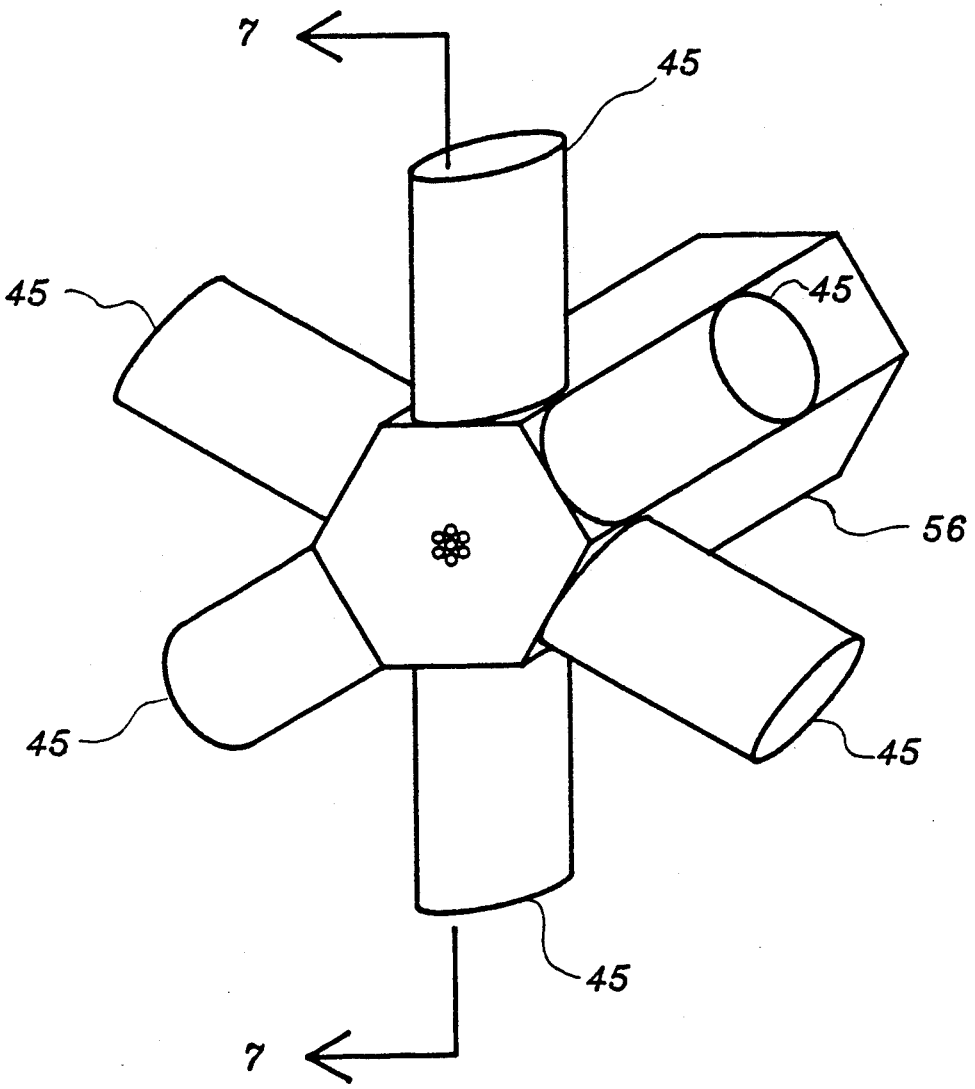
FIG. 6 illustrates a six liquid, single nozzle configuration with valves attached.

In some applications, e.g. for use with the CLT as in FIG. 4, a multiple liquid, single nozzle arrangement has some advantages. FIG. 6 illustrates a single nozzle 56 with six valves 45 attached and having the capability of spraying six different liquids. A single gas orifice and gas pressure applied to an inlet gas port determine the spray pattern characteristics, and the liquids sprayed are determined by the valves that are open.

Figure 7:
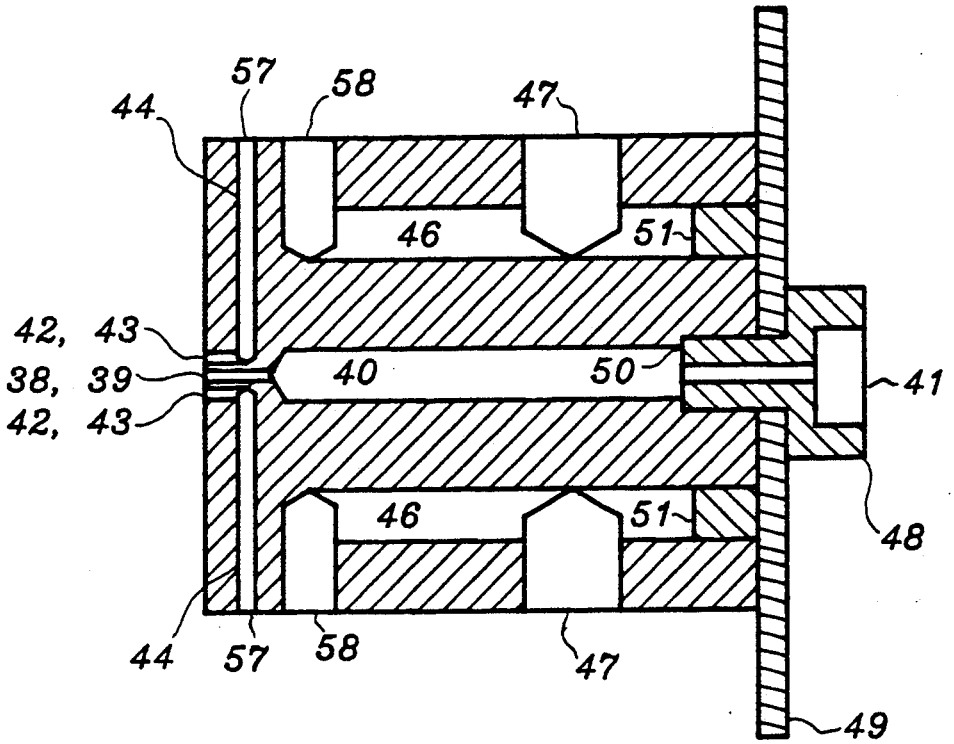
FIG. 7 is a section view taken along line 7—7 in FIG. 6 but with valves removed.

FIG. 7 is a sectional view of the multiple liquid nozzle of FIG. 6, but without the valves. Illustrated are gas orifice 38, exit gas passageway 39, intermediate gas passageway 40, and inlet gas port 41. Also illustrated are liquid orifices 42, exit liquid passageways 43, intermediate liquid passageways 44 connecting the exit liquid passageways with the valve outlet ports at points 57, and intermediate liquid passageways 46 connecting the valve inlet ports at points 58 with the inlet ports 47. Bushing 48 which mounts the nozzle to flange 49 is axially drilled and ported for the inlet gas port 41. Sealant 50, for example Loctite No. PST565 from Loctite Corp. of Newington CT, prevents gas from escaping the intermediate gas passageway past the threads of bushing 48. Plugs 51 block one end of the holes required to drill parts of the intermediate liquid passageways.

Several advantages of the nozzle in FIGS. 6 and 7 will be apparent. No arrangement of separate nozzles is required to achieve a common target area for the six liquids sprayed, nor is the target distance important in achieving a common target area. Because of the reduced number of setups, holes drilled, and other operations required when compared with the alternative of manufacturing multiple copies needed for an equivalent array of the single liquid nozzles, manufacturing cost of the multiple liquid nozzle is considerably reduced. Operational cost is reduced from an array of single liquid nozzles because a smaller gas supply is required for the one gas orifice than for multiple gas orifices. Independent control of the six valves on or off allows $2^6=64$ combinations of states for the six valves. More generally, if the nozzle has the capability of spraying n liquids, then $2^n$ spray combinations are possible. The n control signals for the n valves can, for example, be in direct correspondence with the n bits of a binary representation of the spray combination. Consequently, including the no-spray (all valves off) combination, there are 64 different spray combinations or colors possible for the nozzle of FIG. 6, assuming each of the six liquids is of a different color. Further, by controlling the liquid pressures, the amounts of the liquids as well as their presence or absence in the mix can be controlled. By this means an unlimited variety of spray combinations is possible with a limited number of liquids. For example, if we believe that three primary colors can be used to produce all the other colors, then only a three liquid, single nozzle system need be used. Simultaneous actuation of more than one valve at a time in a multiple liquid, single nozzle configuration is more practical than for an array of single liquid nozzles because there is an inherent mixing of the different liquids as well as a common target area that is independent of target distance. It is clear that characteristics other than color could be used to distinguish between the different liquids and hence the different spray combinations. As an example, the liquids could each contain traces of a different element whose presence, absence, or quantity could be detected in the spray combination.

Another application of the multiple liquid nozzle involves the use of just two different liquids A and B. Then, in a machine such as the CLT in which a varying material property value is measured, a continually varying mark can be applied to the material as a function of the measured property value by properly controlling the inlet liquid port pressures. For example, if the measured property value P can vary between the limits L on the low end and H on the high end, the pressure for liquid A can be set to a value which is a function of the difference H minus P and the pressure for liquid B can be set to a value which is a function of the difference P minus L. Thus, if the functions of the difference H minus P or the difference P minus L are respectively proportional to these differences, then when the value P is small, the pressure for liquid A is large and for liquid B is small, thereby causing the ink spray mark to be primarily from liquid A. When the value P is large, the pressure for liquid A is small and for liquid B is large, causing the spray mark to be primarily from liquid B. In general as P varies from L to H, a characteristic of the spray mark, for example color, takes on a continuum of values in a one-to-one correspondence with the property value P. This opens the possibility of making the property value discernible from the spray mark on the material.

A binary coded color spray marking system would use the multiple liquid nozzle to spray mark the material so that a measured property value can be determined from the spray mark. The measured property value is first coded into an n-bit binary representation by well known methods. A multiple liquid nozzle is used with n different color liquids, each liquid corresponding to one of the n bits. Each liquid is valved on or off according to whether its corresponding bit is on or off. Thus the spray combination is uniquely set into correspondence with property value.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. A spray marking nozzle for spraying a target material with a liquid spray using a gas transporting medium comprising:

a substantially flat exit surface;

an exit liquid passageway in the shape of a circular cylinder with the longitudinal axis intersecting and substantially perpendicular to the exit surface;

an exit gas passageway adjacent and substantially parallel with the exit liquid passageway, the exit gas passageway being in the shape of a circular cylinder with the longitudinal axis intersecting and substantially perpendicular to the exit surface;

an inlet gas port connected to a source of pressurized gas;

an inlet liquid port connected to a source of liquid with means for controlling the liquid pressure at the inlet liquid port;

an intermediate gas passageway connecting the inlet gas port with the exit gas passageway;

an intermediate liquid passageway connecting the inlet liquid port with the exit liquid passageway;

a gas orifice which is the intersection of the exit gas passageway with the exit surface; and a liquid orifice which is the intersection of the exit liquid passageway with the exit surface, the liquid orifice adjacent the gas orifice with adjacency being defined to assure that pressure outside the liquid orifice is controlled sufficiently according to Bernoulli's law by a gas flow from the gas orifice so that liquid flow from the liquid orifice is reliably drawn into the gas flow, such that the gas flow transports the liquid in a crisp highly resolvable pattern to the target material, the liquid orifice being sufficiently small, and the cavity comprising the exit liquid passageway and the intermediate liquid passageway being sufficiently stiff that liquid surface tension prevents liquid from exiting the liquid orifice when liquid flow is zero at the inlet liquid port.

2. The nozzle of claim 1 wherein the exit surface, the exit liquid and gas passageways, the liquid and gas orifices, the inlet liquid and gas ports, and the intermediate liquid and gas passageways are of one piece construction.

3. In a machine having the capability of processing material, a bar code spray marking system comprising:

the nozzle of claim 1;

a coder for converting a data value to a bar code sequence of on and off binary values;

a controller for providing a control signal from the bar code sequence of binary values; and valving means for sequentially valving on or off the liquid through the nozzle in response to the control signal, whereby a track of spray marks is applied to the material, and the data value can be read from the spray marks, reading them as a bar code.

4. An array of nozzles, each nozzle as in claim 1, physically arranged so that the nozzles can be independently aimed at desired locations on the target material.

5. In a machine having the capability of processing material, a binary coded spray marking system comprising:

a coder for converting a data value to an n-bit binary code;

the array of nozzles of claim 4, wherein the number of nozzles in the array is n, each nozzle being aimed at a physical track on the material that is identifiable with a unique bit of the n-bit binary code;

valving means for valving on or off the liquid through each nozzle according to whether its corresponding bit in the binary code for the data value is on or off; and a controller for controlling the valving means according to the n-bit binary code, whereby n tracks of spray marks are applied to the material, and the data value can be read from the spray marks as a binary code.

6. In a machine having the capability of processing material, a dot matrix spray marking system comprising:

the array of nozzles of claim 4, wherein each nozzle is aimed at a physical track on the material;

a coder for converting a data value to a dot matrix code;

a controller for developing from the dot matrix code a control signal for each nozzle; and valving means for valving on or off the liquid through each nozzle in response to the control signal for that nozzle, whereby for each nozzle a track of spray marks is applied to the material, and the data value can be read as a dot matrix of readable characters from the spray marks on the material.

7. The array of claim 4 wherein the exit surfaces of all the nozzles comprise a common exit surface, and wherein the common exit surface, the exit liquid and gas passageways, the liquid and gas orifices, the inlet liquid and gas ports, and the intermediate liquid and gas passageways in combination are of one piece construction.

8. The array of claim 4 wherein the intermediate gas passageways at their inlet gas port end are combined at a common inlet gas port, all but one inlet gas port being eliminated.

9. In a machine having the capability of measuring and identifying the category of a varying property as material moves through the machine, an improved spray marking system comprising:

a plurality of nozzles, each nozzle as in claim 1;

a plurality of liquid valving means, one operatively connected to each nozzle for controlling the flow of liquid through the nozzles; and a means for actuating the plurality of liquid valving means in response to signals from the machine, whereby the category of the varying property can be directly identified at each position by spray marks on the material.

10. The machine of claim 9 wherein the material is lumber, and the machine is a lumber testing machine.

11. The machine of claim 9 wherein the material is wood veneer, and the machine is a veneer testing machine.

12. A liquid spraying nozzle of one piece construction using gas as a transport medium in combination with a valving means for valving within a specified time interval the flow of liquid through the nozzle, wherein the valving means comprises:

a valve inlet port;

a valve outlet port; and a means of mounting the valving means on the nozzle to allow liquid flow between the valving means and the nozzle through the valve inlet and outlet ports; and wherein the nozzle comprises:

a substantially flat exit surface;

an exit liquid passageway in the shape of a circular cylinder with the longitudinal axis intersecting and substantially perpendicular to the exit surface;

an exit gas passageway adjacent and substantially parallel with the exit liquid passageway, the exit gas passageway being in the shape of a circular cylinder with the longitudinal axis intersecting and substantially perpendicular to the exit surface;

an inlet gas port connected to a source of pressurized gas;

an inlet liquid port connected to a source of liquid with means for controlling the liquid pressure at the inlet liquid port;

an intermediate gas passageway connecting the inlet gas port with the exit gas passageway;

a first intermediate liquid passageway connecting the inlet liquid port with the valve inlet port;

a second intermediate liquid passageway connecting the valve outlet port with the exit liquid passageway;

a gas orifice which is the intersection of the exit gas passageway with the exit surface; and a liquid orifice which is the intersection of the exit liquid passageway with the exit surface, the liquid orifice adjacent the gas orifice with adjacency being defined to assure that pressure outside the liquid orifice is controlled sufficiently according to Bernoulli's law by a gas flow from the gas orifice so that liquid flow from the liquid orifice is reliably drawn into the gas flow, such that the gas flow transports the liquid in a crisp highly resolvable pattern to a target material, the liquid orifice being sufficiently small, and the cavity comprising the exit liquid passageway and the second intermediate liquid passageway being sufficiently stiff that liquid surface tension prevents liquid from exiting the liquid orifice when liquid flow is zero at the valve outlet port.

13. A multiple liquid nozzle for spraying a target material with a liquid spray comprising:

a gas orifice;

a plurality of liquid orifices adjacent the gas orifice with adjacency being defined to assure that pressure outside the liquid orifices is controlled sufficiently according to Bernoulli's law by a gas flow from the gas orifice so that liquid flows from the liquid orifices are reliably drawn into the gas flow, such that the gas flow transports the liquid in a crisp highly resolvable pattern to the target material;

an inlet gas port connected to a source of pressurized gas;

a plurality of inlet liquid ports, each connected to a liquid source;

a plurality of liquid passageways, each connecting one liquid orifice to one inlet liquid port; and a gas passageway connecting the inlet gas port to the gas orifice, whereby a plurality of liquids can be sprayed to a common area on a surface, the liquids transported by the gas flow emanating from the gas orifice.

14. The multiple liquid nozzle of claim 13 in combination with means for controlling liquid pressures at the inlet liquid ports.

15. In a machine having the capability of processing material, a continuum spray marking system which forms a composite spray mark comprising:

the multiple liquid nozzle of claim 13, wherein there are exactly two inlet liquid ports connected to the different liquids A and B; and a means for controlling liquid pressures at the inlet liquid ports as a function of a data value P, P being in the range from L at the low end to H at the high end, whereby a characteristic of the composite spray mark applied to the material takes on a continuum of values in a one-to-one correspondence with the data value as the data value varies in the range from L to H.

16. A spray marking system comprising:

the combination of claim 14, wherein the means for controlling the liquid pressures at the inlet liquid ports includes valving means for controlling the flow of liquid to each of the liquid passageways.

17. In a machine having the capability of processing material, an improved spray marking system comprising:

the spray marking system of claim 16; and controlling means for controlling the valving means for each of the liquids as a function of a category value, whereby the category value can be directly identified by spray marks on the material.

18. In a machine having the capability of processing materials, a binary coded color spray marking system comprising:

a coder for converting a data value to an n-bit binary code;

the spray marking system of claim 16 wherein the number of different liquids and liquid orifices is n, each liquid having of a unique characteristic and corresponding with a unique bit of the n-bit code; and a controller for controlling the valving means according to the n-bit binary code, each liquid being valved on or off depending on whether its corresponding bit is on or off, whereby n combinations of spray mark characteristics can be applied to the material, and the data value can be detected from the combination.

* * * * *